United States Patent [19]

Mesenhimer

[11] Patent Number: 4,531,085

[45] Date of Patent: Jul. 23, 1985

[54] POLYPHASE LINE VOLTAGE REGULATOR

[75] Inventor: Lee O. Mesenhimer, Avon, Ohio

[73] Assignee: Power Distribution Inc., Richmond, Va.

[21] Appl. No.: 503,539

[22] Filed: Jun. 13, 1983

[51] Int. Cl.[3] ..... G05F 3/06

[52] U.S. Cl. ..... 323/214; 323/218; 323/306

[58] Field of Search ..... 363/44, 45, 46, 47, 363/48, 64, 75, 90, 91; 323/218, 214, 215, 306, 308, 361, 362; 307/7

[56] References Cited

U.S. PATENT DOCUMENTS

| | | | |
|---|---|---|---|
| 2,025,584 | 12/1935 | Fitz Gerald | 307/7 |
| 3,379,961 | 4/1968 | Kobayashi et al. | 323/307 |
| 3,500,166 | 3/1970 | Mesenhimer et al. | 363/57 |
| 4,305,033 | 12/1981 | Powell | 323/308 |

*Primary Examiner*—Peter S. Wong
*Assistant Examiner*—Judson H. Jones
*Attorney, Agent, or Firm*—Richard P. Matthews

[57] ABSTRACT

A polyphase line voltage regulator which uses polyphase pulse saturable ferroresonant reactors in series with three separate and equal input chokes. The line voltage regulator is particularly suitable for computer operations which impose a variable current demand on the power source. The input chokes are directly coupled with an unregulated a.c. source and are provided with controlled non-linearity. LC tuned circuits inhibit the second and third harmonics from the regulated a.c. voltage. An isolation transformer is connected across the polyphase pulse saturable ferroresonant reactors and delivers a voltage regulated a.c. output voltage to a load.

7 Claims, 12 Drawing Figures

POLYPHASE LINE VOLTAGE REGULATOR

This invention relates to polyphase line voltage regulators and, more particularly, to such line voltage regulators which employ pulse saturable ferroresonant reactors to supply a regulated voltage especially useful in computer applications.

BACKGROUND OF THE INVENTION

It has been known for quite some time that ferroresonant reactor devices are useful in regulating line voltage and in providing desired sinusoidal waveforms. For example, Karl I. Selin describes in a paper entitled, "The Polyunit Saturable Reactor", Trans. AIEE (Power Apparatus and Systems), vol. 75, Oct. 1956, pp. 863–867, how a saturable reactor having a load current waveform can be used to deliver a sinusoidal output waveform. Also Selin and A. Kusko in a paper entitled, "Experimental Characteristics of the 3-phase Polyunit Saturable Reactor," Trans. AIEE (Power Apparatus and Systems), vol. 75, Oct. 1956, pp. 868–871, describe how reactor units can be made to saturate and unsaturate in a prescribed sequence throughout the cycle of line frequency. Therefore, a polyphase current drawn by the reactor from a source can be shaped to have a nearly sinusoidal waveform.

It is also well known that in computer applications and data processing applications, it is necessary to isolate the load provided by the computer and data processing applications so that aberrations in the power supply wave shape do not result in computing or storage errors. It is also important to provide continuity of power from the power supply so as not to require a shut down in the computer or data processing applications.

In a recently issued patent to Powell U.S. Pat. No. 4,305,033 issued Dec. 8, 1981, it is proposed to recreate a waveform with a synthesizer network and a separate primary winding means. In that device, a separate set of primary windings is coupled with a set of input chokes and magnetically associated with ferroresonant reactor means used to produce the synthesized waveform. This not only requires the winding of primary and secondary windings on the same iron core member along with the input choke windings but also requires the use of shielding means such as Faraday shields between the primary and secondary windings to prevent the transfer of common mode line noise therebetween. The Faraday shields themselves are then grounded. This construction necessarily increases the size of the iron core on which the windings are wound and results in an unusual amount of core losses. These core losses are especially noticeable when variable loads are incurred. This system, furthermore, does not generate a neutral or reference output so that a grounding transformer is required.

SUMMARY OF THE PRESENT INVENTION

The foregoing disadvantages and problems encountered in the known prior art are effectively overcome in the practice of the present invention. In particular, the present invention utilizes a separate isolation transformer between the output of the saturable reactors and the load. Thus, it is possible to design the system so that any desired amount of isolation may be obtained without the concommitant increasing of the core losses of the saturable reactors. Stated differently, the isolation transformer is built for isolation only, not combined with the saturable reactors, so that each unit may be optimized. In this invention only the saturable reactor wire itself is wound on the core of the saturable reactors so that a more compact saturable reactor may be used. Further, by using a delta primary and a Y secondary in the isolation transformer, no separate grounding transformer is required. This feature not only reduces the complexity of the system but also makes it less expensive.

The inherent advantages and improvements of the present invention will become more readily apparent upon reference to the following detailed description of the invention and by reference to the drawings wherein.

DETAILED DESCRIPTION OF A PREFERRED EMBODIMENT

Figure 1:
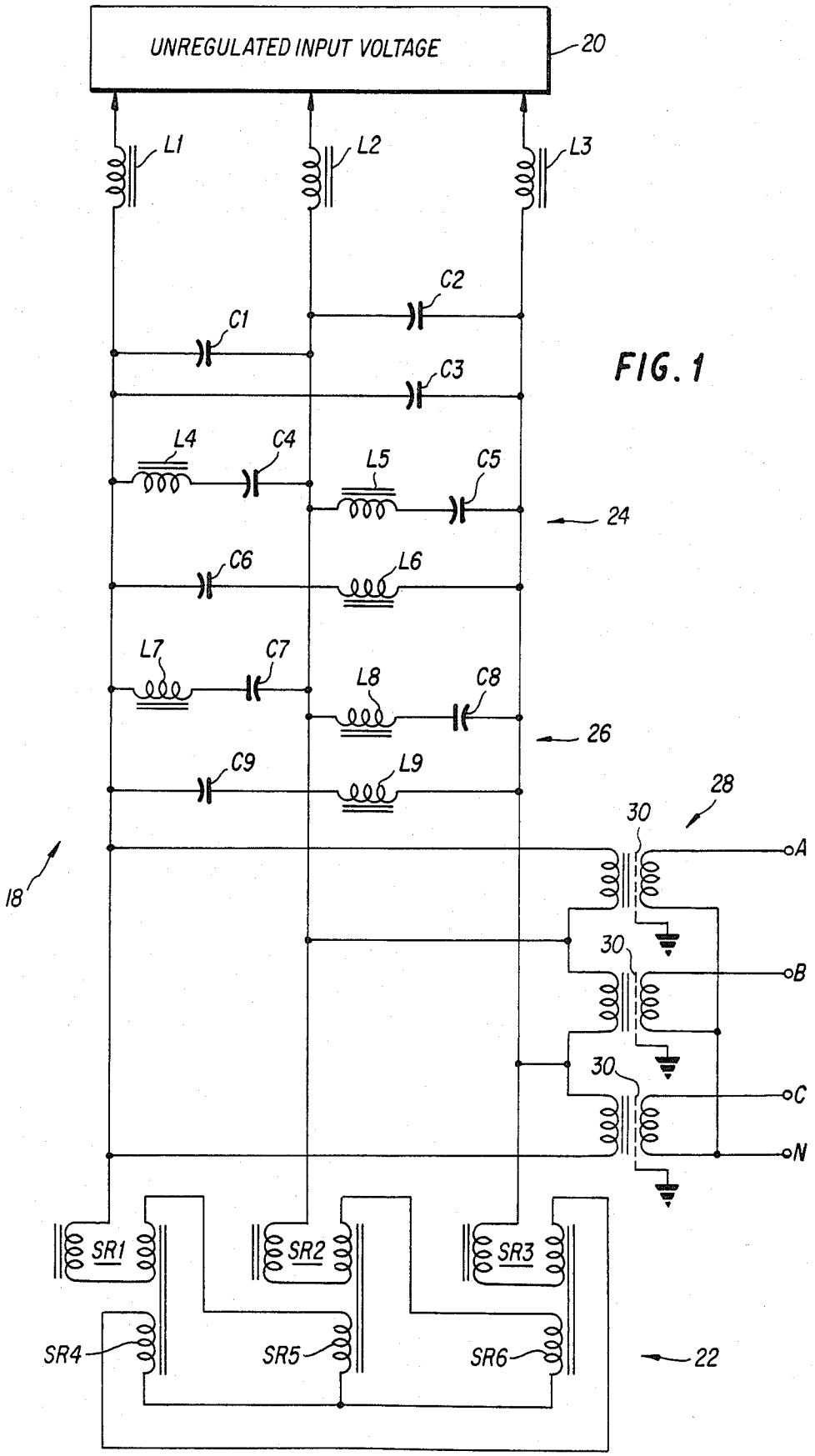
FIG. 1 is a schematic diagram of a three phase line voltage regulator made in accordance with the present invention.

Referring now to FIG. 1 of the drawings, there is illustrated a schematic diagram of the preferred embodiment of a polyphase voltage regulator indicated generally at 18. An unregulated input voltage source 20 is supplied to three non-linear line inductors designated L1, L2 and L3. This desired non-linearity of inductors L1, L2 and L3 is effected in a manner similar to that disclosed in my U.S. Pat. No. 3,500,166 issued Mar. 10, 1970. For example, this is preferably effected by removing a portion of the tongue or center leg and a laminated core. Non-linearity is produced by having one or more smaller sections of the laminated stack having a smaller equivalent gap. One technique is to use a stepped gap or fewer series gaps than the main section. The gaps are preferably in the tongue or center leg only so as to minimize the external magnetic field. The non-linearity feature provides stability to the system.

Capacitors C1, C2 and C3 constitute the main a.c. capacitor bank for the ferroresonant circuit and are connected across the regulated voltage. Saturable reactors SR1, SR2, SR3, SR4, SR5 and SR6 are also connected across the regulated voltage and are collectively designated 22. Other arrangements of saturable reactors are possible.

A series of second harmonic traps are designated generally at 24. These second harmonic traps are tuned circuits L4, C4 connected across C1; L5, C5 connected across C2; and L6, C6 connected across C3, each tuned at 120 Hz. A third harmonic tuned trap circuit is designated generally at 26 and includes L7, C7 across C1; L8, C8 connected across C2; and L9, C9 connected across C3. Each component of the third harmonic trap 26 is tuned at 180 Hz. Prevention of these harmonics is well known in the art to prevent a wrong mode of operation and to improve the desired sinusoidal output waveform.

Since isolation from the power source in the form of an unregulated input voltage 20 is desired to isolate input voltage line spikes and common mode line spikes from the output voltage, a separate isolation transformer, indicated generally at 28 is employed. Isolation transformer 28 is provided with inter-winding shields 30. Furthermore, isolation transformer 28 has its primary windings wound in delta connection and its secondary windings wound in Y connection thereby eliminating the need for a grounding transformer. The regulated three phase voltage is delivered at terminals A, B, C with N being a neutral connection. Because the isolation transformer is separate from the ferroresonant saturable reactors 22, it may be designed to do an optimum job of isolating without concern of space limitations that would be experienced if the two were to be combined. The requirement for interwinding shields 30 would simply compound the space problem if the two were combined. Similarly, because the ferroresonant saturable reactors 22 are separate from the isolation transformer 28, all available space on the cores of the saturable reactors may be used for the saturable reactor windings. Thus, for a given power rating, the cores of the saturable reactors SR1, SR2, SR3, SR4, SR5 and SR6, may be made smaller in accordance with the present invention than when the saturable reactors are combined with an isolation transformer and necessary inter-winding shields. Consequently, smaller core losses ensue in the practice of the present invention.

Figure 2:
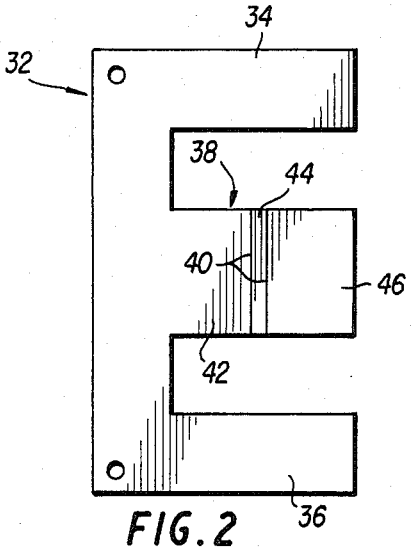
FIG. 2 is plan view illustrating a method step in manufacturing a line inductor core for use in the present invention.
Figure 3:
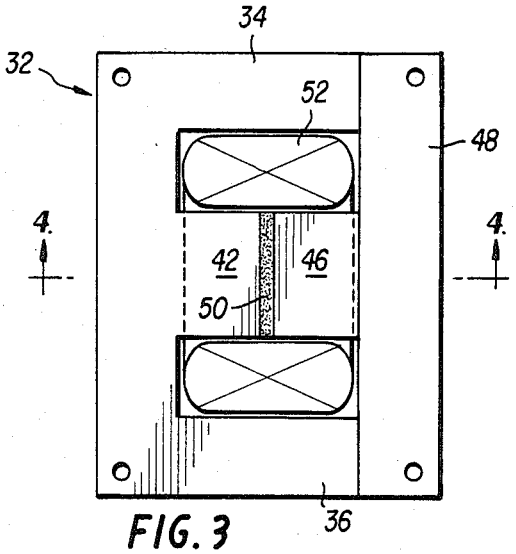
FIG. 3 is a plan view showing a step subsequent to that shown in FIG. 2 in the manufacture of a line inductor core.
Figure 4:
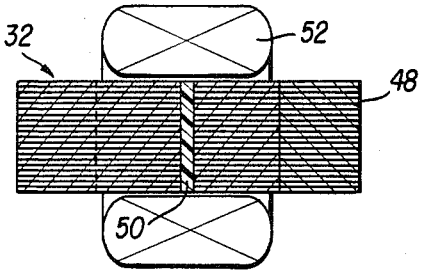
FIG. 4 is an elevational view taken in vertical cross section along line 4—4 of FIG. 3.

Referring now to FIG. 2 of the drawings, an E-shaped core structure for a line inductor is indicated generally at 32. Core structure 32 has an upper leg 34, a lower leg 36 and a middle leg or tongue indicated generally at 38. It is desirable to provide a gap in the middle leg 38 to minimize the external magnetic field and maximize the physical strength. To this end, a pair of parallel cuts 40 are made in a shear leaving an attached portion 42, a scrap portion 44 and a severed portion 46 which is then secured as shown in FIG. 3 with an end plate or I-shaped core 48. The gap provided by the scrap portion 44 may be filled with a non-conducting spacer 50. The coil 52 is wound around portions 42 and 46 as seen in both FIGS. 3 and 4.

Figure 5:
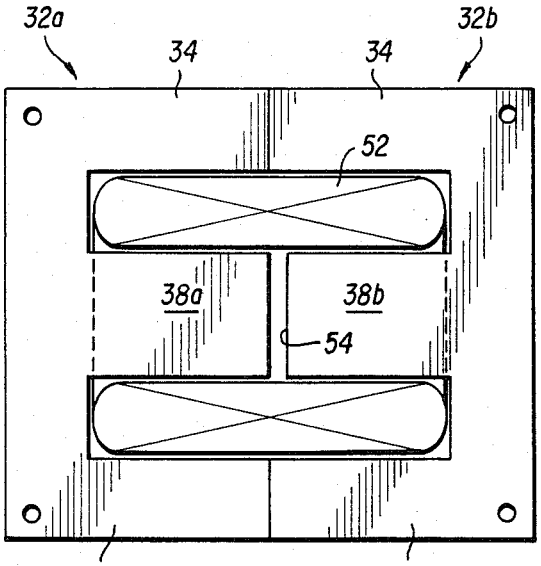
FIG. 5 is a plan view of a modified line inductor core.

A modified structure for a single gap line inductor is illustrated in FIG. 5. In this form, the left hand E-shaped core **32*a* is left with its central leg or tongue 38*a* having uncut laminations. However, the right hand E-shaped core 32*b* has its central leg or tongue 38*b* foreshortened at 54 thereby creating a gap between the adjacent tongues 38*a*, 38*b* when the cores are positioned as shown with corresponding legs 34, 36 brought into abutment and coil 52 wound on the tongues 38*a*, 38*b***.

Figure 6:
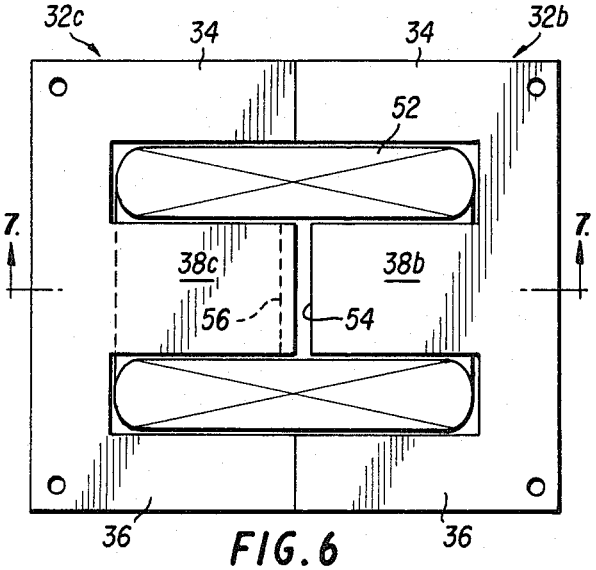
FIG. 6 is a plan view of a further modified line inductor core.
Figure 7:
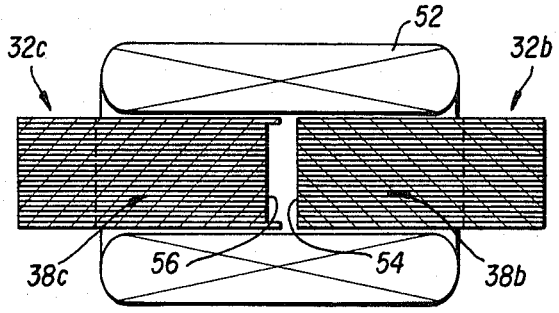
FIG. 7 is a plan view taken in horizontal cross section along line 7—7 of FIG. 6.

Another modification in the core structure is illustrated in FIGS. 6 and 7. In this embodiment, an E-shaped core **32*c* has a stepped gap provided in one of two ways. Either the central leg has all such legs in a stack notched out at 56 or certain ones of the legs in the middle of a stack are foreshortened by cutting all the way across while the central legs of certain laminations at opposed ends are uncut. In either event, the abutting E-shaped core laminations of core 32*b* has its central leg or tongue 38*b* foreshortened, as before, at 54**. Thus, non-linearity is produced by having one or more smaller sections of the stack having a smaller equivalent gap.

Figure 8:
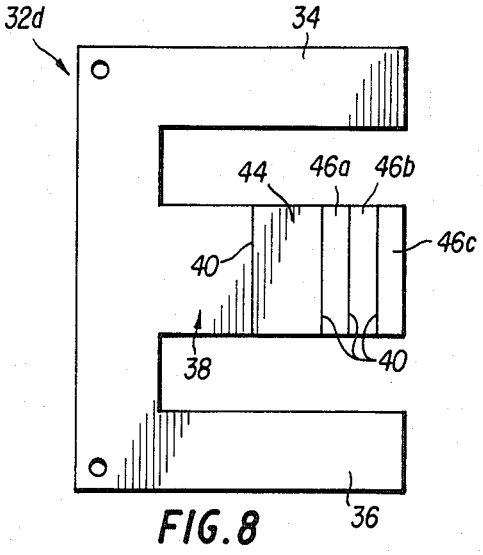
FIG. 8 is a plan view illustrating a method step for making a line inductor core with three gaps.
Figure 9:
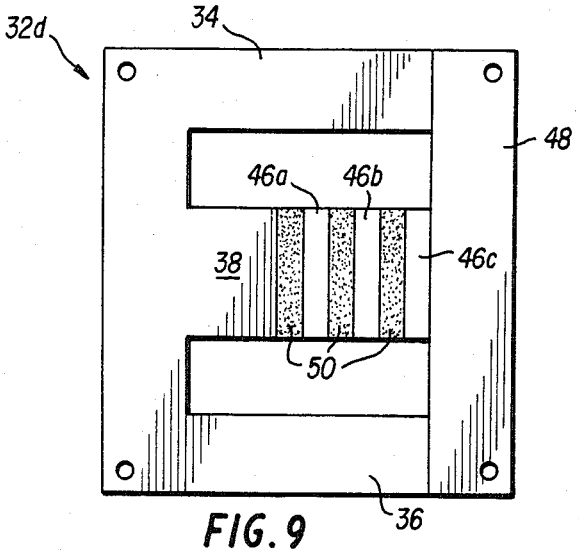
FIG. 9 is a plan view showing a completed line inductor subsequent to the step shown in FIG. 8.

In FIGS. 8 and 9 still another modification is shown. In this embodiment, E-shaped core **32*d* has a series of four cuts made to define scrap portion 44 and severed portions 46*a*, 46*b*, and 46*c*. The latter three portions are incorporated into the core structure with the aid of I-shaped core 48 and with the gaps filled with non-conducting spacers 50**.

Figure 10:
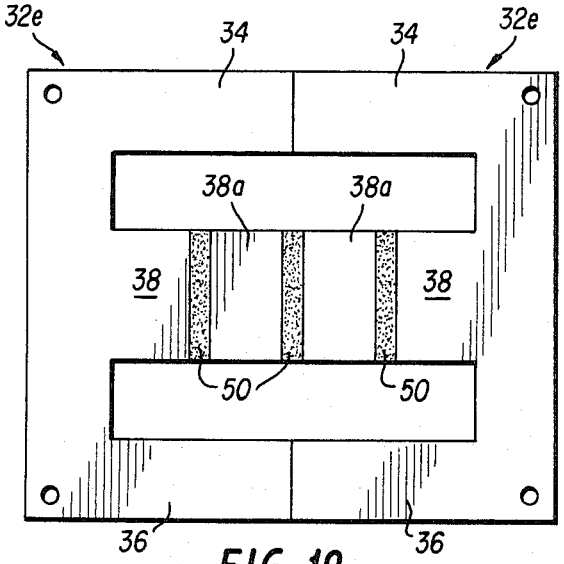
FIG. 10 is a plan view of still another modified line inductor core.

One final embodiment is illustrated in FIG. 10. In this embodiment, two similar E-shaped cores **32*e* have each had a scrap portion removed and a severed portion 38*a* from each middle leg or tongue 38 so positioned to establish three gaps each of which may be filled with non-conducting spacer members 50**.

Figure 11:
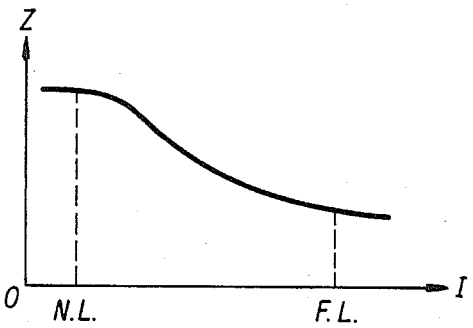
FIG. 11 is a curve of impedance plotted against current for a non-linear inductor.

In constructing these non-linear inductors it is desirable to derive a curve for each inductor by plotting the impedance in average ohms against current in amperes. A preferred shape for these curves is as shown in FIG. 11 wherein the impedance rises from a full load condition as the current is reduced until a value corresponding to no-load is reached which is about 10 percent of full load current. At this point, the impedance curve should flatten out and preferably not continue to rise for lower currents.

For high power requirements, line inductors L1, L2 and L3 can be made larger or have several inductors placed in parallel to the extent that this is convenient and economical. The saturable units which comprise SR1, SR2, SR3, SR4, SR5 and SR6 present a more difficult problem in high power requirements because they control the output voltage. When saturable units or, preferably, sets of saturable units are connected in parallel, the currents and self heating can become significantly unbalanced unless the units are accurately measured and used in matched sets. Test circuits are illustrated in FIG. 12.

Figure 12:
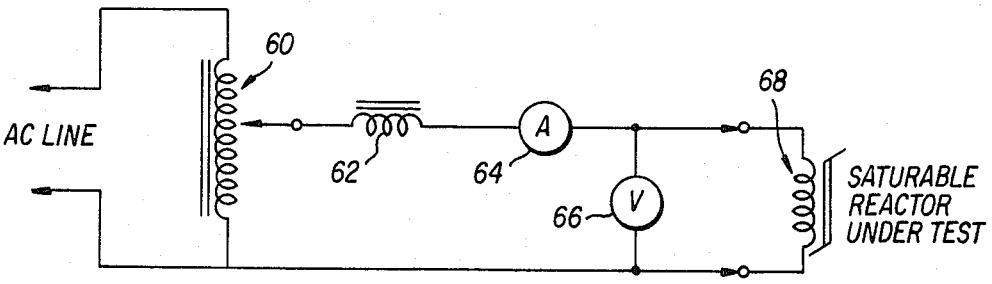
FIG. 12 is a schematic diagram of a circuit used to test a saturable reactor.

In FIG. 12, a variable transformer, indicated generally at 60, receives an a.c. single phase line with a waveform imposed thereon preferably similar to the working waveform. Inductor 62 is not critical nor is an a.c. ammeter 64. An a.c. voltmeter 66 is preferably of the rectifier type, either moving coil or digital. Voltmeter 66 may be calibrated in terms of the RMS of a sine wave but average responding. Voltmeter 66 measures the voltage applied to a saturable reactor 68 which is being tested.

In the circuit of FIG. 12, a desired current is passed through the saturable reactor 68 under test. The voltmeter 66 is then read and laminations are removed, or added, from the saturable unit 68 until the desired voltage is read. Since the unit being measured is a voltage regulating device, the current does not have to be precise.

A number of changes and modifications can be made in the practice of the present invention. For example, the isolation transformer 28 may be a three phase Y to Y connection with auxiliary windings as an internal part of the transformer. Also the isolation transformer 28 could comprise three single phase transformers.

A neutral connection is not always required in which instance the isolation transformer 28 could precede the circuit of FIG. 1. Also in the circuitry of FIG. 1, the isolation transformer 28 could be pre-existing in a power panel in which instance it need not be provided again.

It is also possible for the circuitry of FIG. 1 to function with a single phase input and a three phase output, but it would not be self-starting in this instance. For example, it is possible for one of the line inductors L1, L2, or L3 to be open, and the circuit of FIG. 1 will still deliver a regulated voltage output. Also the inductors L1, L2 and L3 need not be equal if L1, L2 or L3 of FIG. 1 were shorted out or omitted, the circuit of FIG. 1 will still deliver a regulated voltage output although the output would not be balanced against ground.

While presently preferred embodiments of the invention have been illustrated and described, it will be recognized that the invention may be otherwise variously embodied and practiced within the scope of the claims which follow.

I claim:

1. A polyphase line voltage regulator for use with an unregulated a.c. source of variable voltage level and waveshape and of a given frequency for providing a regulated a.c. voltage output to a load having a variable current demand which comprises:

a. input inductor means each coupling one phase of unregulated input voltage to one phase of a regulated output voltage, 1. said input inductor means being provided with controlled non-linearity, b. a main a.c. capacitor bank connected in delta across the regulated voltage, c. LC tuned circuits connected across said capacitor bank and tuned to the second and third harmonics of said unregulated a.c. source, d. polyphase pulse saturable reactor means connected across said capacitor bank to regulate the voltage, e. and isolation transformer means connected across said polyphase pulse saturable reactor means to deliver a regulated a.c. voltage output to said load.

2. A polyphase line voltage regulator as defined in claim 1 wherein said isolation transformer means has its secondary arranged in Y connection to avoid the necessity for a grounding transformer.

3. A polyphase line voltage regulator as defined in claim 1 wherein said isolation transformer means constitutes a set of three separate single phase transformers each connected delta to Y to avoid the necessity for a grounding transformer.

4. A polyphase line voltage regulator as defined in claim 1 wherein said isolation transformer means has its primary to secondary windings connected in delta to Y to avoid the necessity for a grounding transformer.

5. A polyphase line voltage regulator as defined in claim 1 wherein said input inductor means are each provided with an iron core with multiple gaps therein.

6. A polyphase line voltage regulator as defined in claim 1 wherein said unregulated a.c. source is single phase and said regulated a.c. output is three phase.

7. A polyphase line voltage regulator as defined in claim 1 wherein said input inductor means is physically removed from and magnetically unassociated with said polyphase pulse saturable reactor means.

* * * * *